US012262733B2

(12) United States Patent
Hwang et al.

(10) Patent No.: US 12,262,733 B2
(45) Date of Patent: Apr. 1, 2025

(54) SMOKING ARTICLE FROM WHICH SOUND IS GENERATED

(71) Applicant: KT&G CORPORATION, Daejeon (KR)

(72) Inventors: Min Hee Hwang, Daejeon (KR); Soo Ho Kim, Daejeon (KR); Chang Jin Park, Daejeon (KR); Won Ho Kim, Daejeon (KR); Jong Yeol Kim, Daejeon (KR); Han Joo Chung, Daejeon (KR); Yong Sook Jin, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 704 days.

(21) Appl. No.: 17/437,247

(22) PCT Filed: Mar. 8, 2021

(86) PCT No.: PCT/KR2021/002810
§ 371 (c)(1),
(2) Date: Sep. 8, 2021

(87) PCT Pub. No.: WO2021/235660
PCT Pub. Date: Nov. 25, 2021

(65) Prior Publication Data

US 2023/0172260 A1 Jun. 8, 2023

(30) Foreign Application Priority Data

May 19, 2020 (KR) ..... 10-2020-0059460

(51) Int. Cl.
*A24F 40/40* (2020.01)
*A24C 5/60* (2006.01)
(Continued)

(52) U.S. Cl.
CPC ..... *A24D 1/025* (2013.01); *A24C 5/603* (2013.01); *A24D 1/002* (2013.01)

(58) Field of Classification Search
None
See application file for complete search history.

(56) References Cited

U.S. PATENT DOCUMENTS

2006/0144412 A1 7/2006 Mishra et al.
2007/0274930 A1 11/2007 Witteveen et al.
2008/0216851 A1* 9/2008 Olegario ..... A24D 3/043 131/202

FOREIGN PATENT DOCUMENTS

CN 105813486 A 7/2016
JP S4723500 U 11/1972
(Continued)

OTHER PUBLICATIONS

Communication dated Sep. 13, 2022 from the Japanese Patent Office in Application No. 2021-532488.
(Continued)

*Primary Examiner* — Phu H Nguyen
(74) *Attorney, Agent, or Firm* — Sughrue Mion, PLLC

(57) ABSTRACT

Provided herein is a smoking article from which sound is generated. The smoking article according to some embodiments of the present disclosure may include a filter portion and a smoking material portion, and a sound-generating material including a carbohydrate material may be added to the smoking material portion. The sound-generating material may generate sound as the material burns, and the sound may further provide an auditory effect during smoking. In this way, an improved smoking experience may be provided to the smoker.

16 Claims, 6 Drawing Sheets

(51) Int. Cl.

| | |
|---|---|
| ***A24D 1/00*** | (2020.01) |
| ***A24D 1/02*** | (2006.01) |
| ***A24F 40/10*** | (2020.01) |
| ***A24F 40/51*** | (2020.01) |
| ***A24F 40/60*** | (2020.01) |
| ***A24F 40/70*** | (2020.01) |
| ***A24F 40/95*** | (2020.01) |
| ***A61M 15/00*** | (2006.01) |

(56) References Cited

FOREIGN PATENT DOCUMENTS

| | | | |
|---|---|---|---|
| JP | 2014-526240 | A | 10/2014 |
| JP | 2017-500864 | A | 1/2017 |
| KR | 10-2008-0070119 | A | 7/2008 |
| KR | 10-2010-0024251 | A | 3/2010 |
| KR | 10-2014-0058566 | A | 5/2014 |
| WO | 2014/156838 | A1 | 10/2014 |
| WO | 2021/125444 | A1 | 6/2021 |

OTHER PUBLICATIONS

Office Action dated Apr. 25, 2023 in Chinese Application No. 202180006253.8.

Extended European Search Report dated Apr. 14, 2022 in Application No. 21735566.8.

* cited by examiner

[FIG. 1]
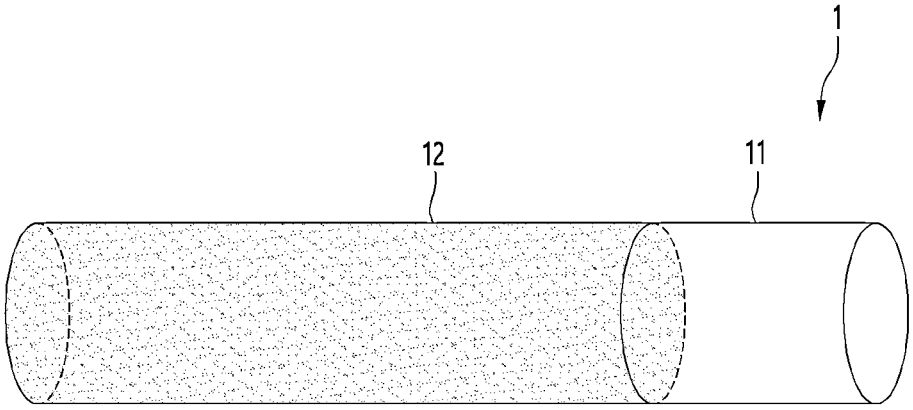
[FIG. 2]
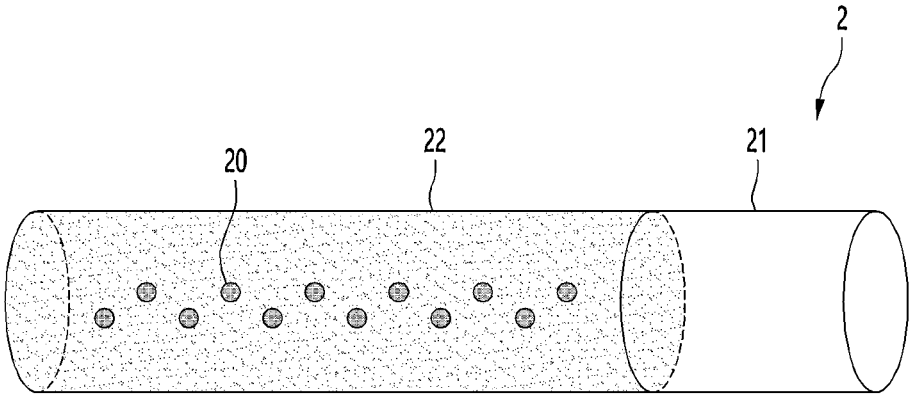

[FIG. 3]
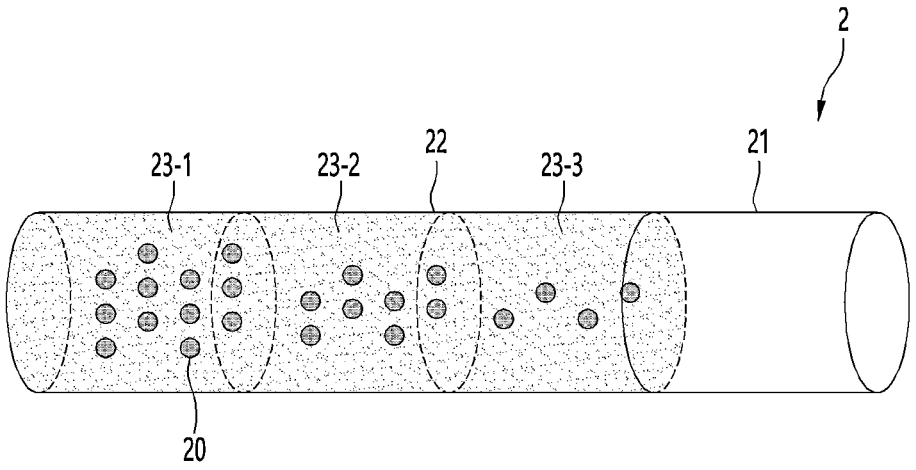
[FIG. 4]
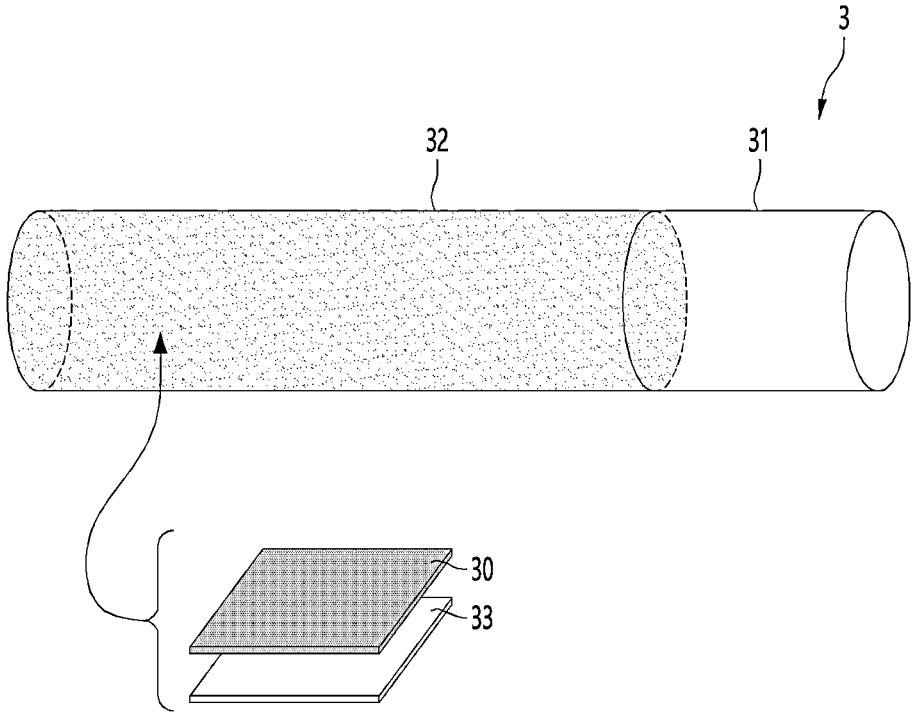

[FIG. 5]
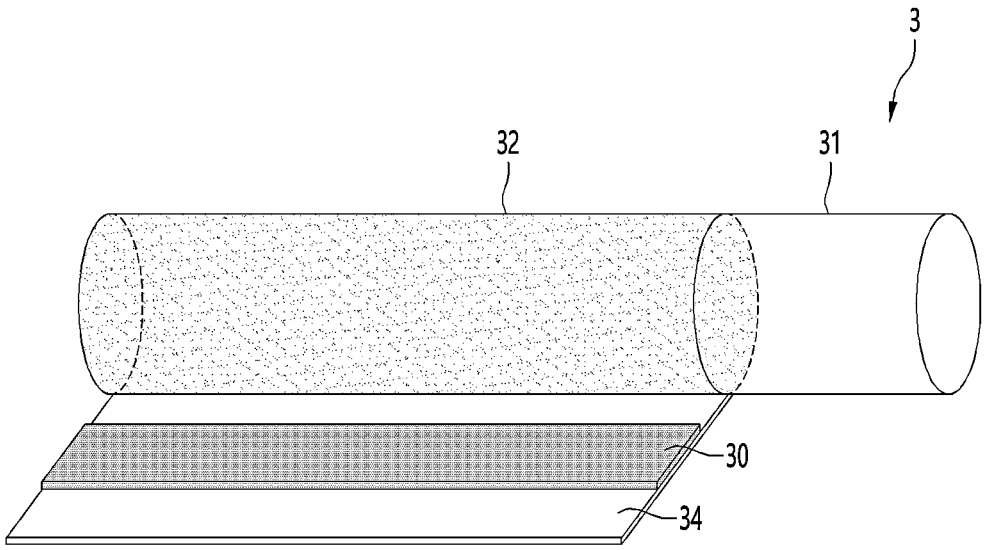
[FIG. 6]
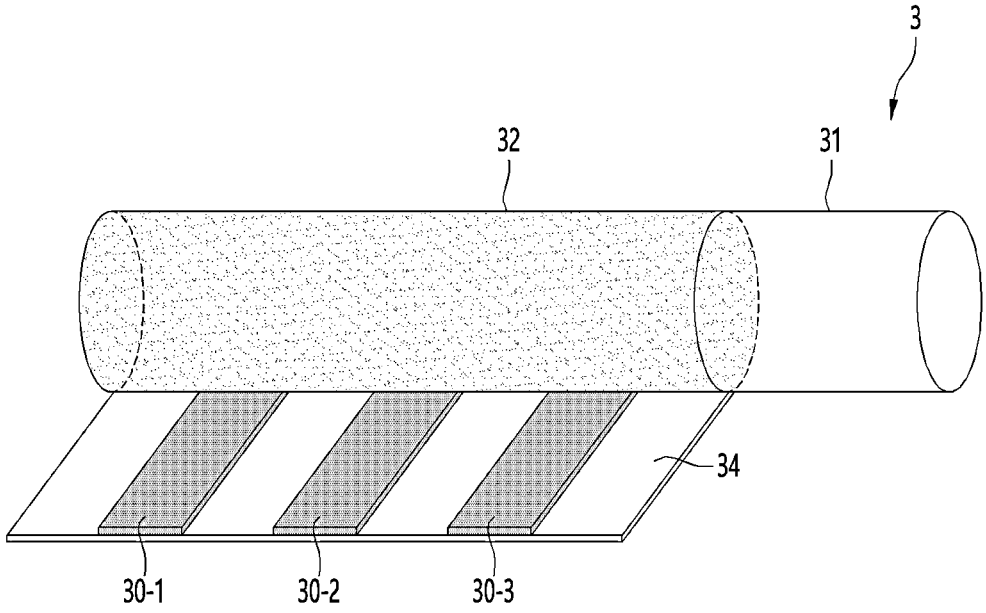

[FIG. 7]
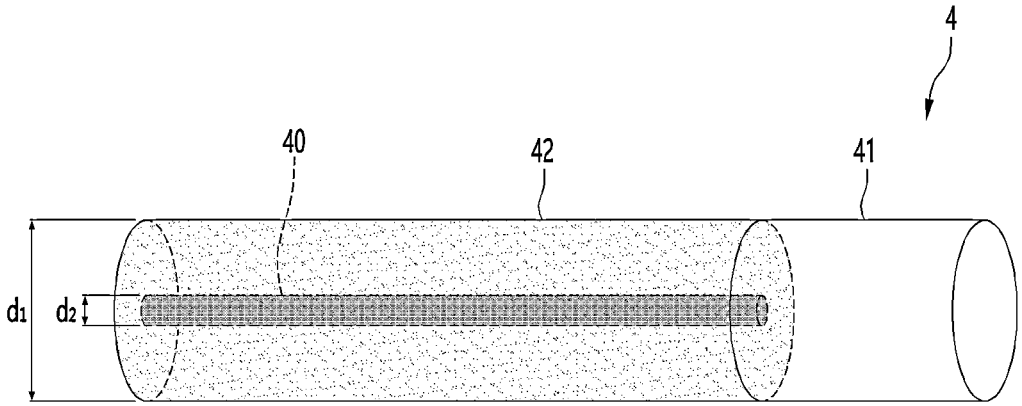
[FIG. 8]
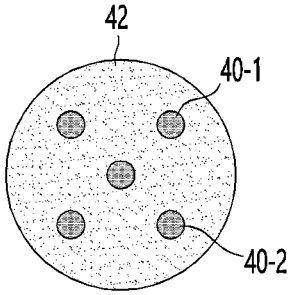
[FIG. 9]
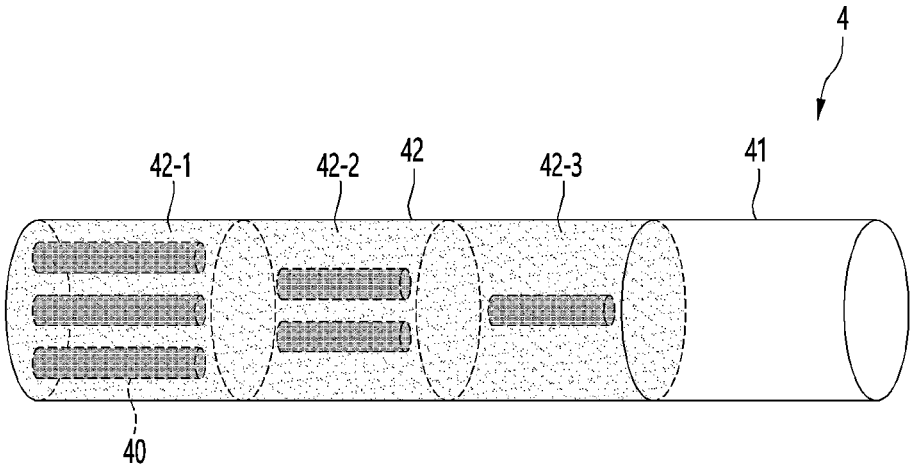

[FIG. 10]
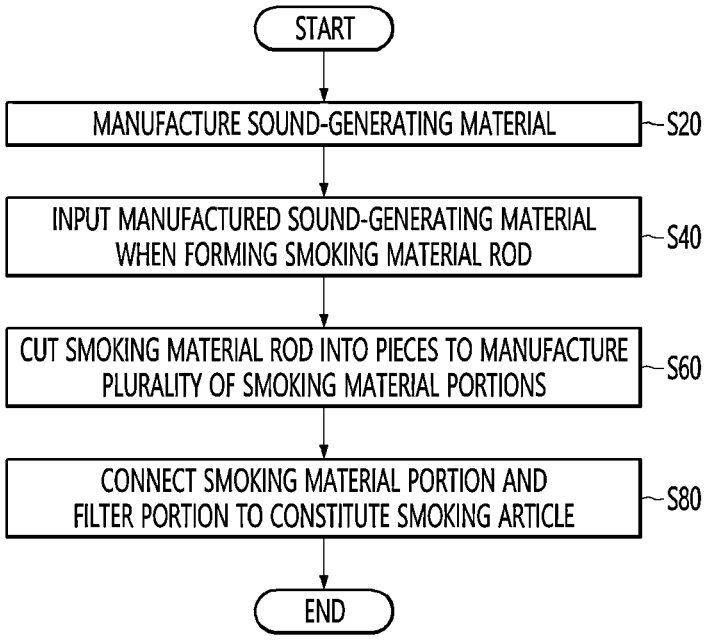
[FIG. 11]
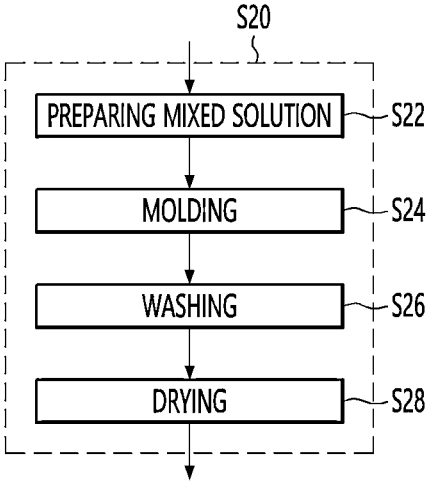

[FIG. 12]
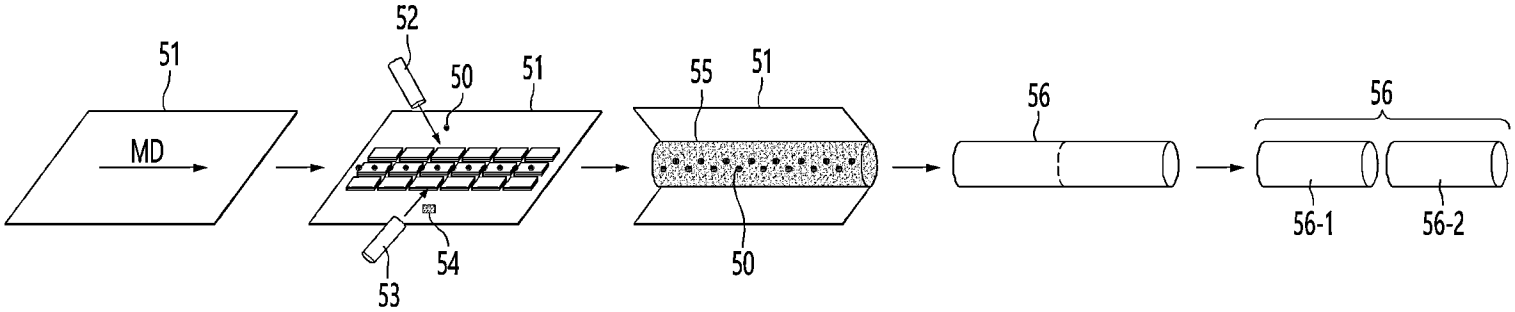

SMOKING ARTICLE FROM WHICH SOUND IS GENERATED

TECHNICAL FIELD

The present disclosure relates to a smoking article from which sound is generated, and more particularly, to a smoking article capable of providing an improved smoking experience to a smoker by further providing an auditory effect during smoking.

BACKGROUND ART

Studies on technology that can provide differentiated smoking experiences through smoking articles have been being actively conducted. However, most of the existing studies focus on differentiation in terms of taste, smell, and/or sight among various senses of consumers, and studies for auditory differentiation are very insufficient. For example, topics of the existing studies focus on technology for flavoring smoking articles (i.e., gustatory/olfactory differentiation), technology for enhancing vapor production of smoking articles (i.e., visual differentiation), and the like.

Meanwhile, Indonesian kretek cigarettes are an example of smoking articles relating to auditory differentiation. The kretek cigarettes generate a crackling (or "kretek-kretek") sound as a clove material burns during smoking. The name "kretek" is also derived from this feature.

However, kretek cigarettes are cigarettes to which a clove material is added to express a clove flavor (that is, for gustatory/olfactory differentiation). Thus, strictly speaking, kretek cigarettes are not a product of studies for auditory differentiation. Also, since the clove material added to kretek cigarettes has irregular arrangement, the sound generated during smoking has an irregular pattern (e.g., sound intensity, sound generation intervals). As such, the sound may sometimes be perceived as noise by a smoker and may provide a rather degraded smoking experience. Further, users who are not familiar with the clove flavor may feel a strong aversion to kretek cigarettes.

DISCLOSURE

Technical Problem

Some embodiments of the present disclosure are directed to providing a smoking article capable of, by further providing an auditory effect during smoking, providing an improved smoking experience to a smoker.

Some embodiments of the present disclosure are also directed to providing a smoking article capable of continuously generating constant sounds during smoking.

Some embodiments of the present disclosure are also directed to providing a sound-generating smoking article that is easy to manufacture at low cost.

Some embodiments of the present disclosure are also directed to providing a material, from which sound is generated as the material burns, and a method of manufacturing the same.

Some embodiments of the present disclosure are also directed to providing a sound-generating material, which may be universally applied to various smoking articles, and a method of manufacturing the same.

Objectives of the present disclosure are not limited to the above-mentioned objectives, and other unmentioned objectives should be clearly understood by those of ordinary skill in the art to which the present disclosure pertains from the description below.

Technical Solution

A smoking article according to some embodiments of the present disclosure includes a filter portion and a smoking material portion to which a sound-generating material is added, wherein the sound-generating material includes a carbohydrate material.

In some embodiments, an intensity of sound generated from the smoking article during smoking may be in a range of 20 dB to 80 dB.

In some embodiments, the sound-generating material may include the carbohydrate material in an amount greater than or equal to 15 wt %.

In some embodiments, the sound-generating material may further include glycerin.

In some embodiments, the sound-generating material may further include at least one material of propylene glycol (PG), a medium chain fatty acid triglyceride (MCTG), and a flavoring material.

In some embodiments, the sound-generating material may include 15 wt % to 90 wt % carbohydrate material, 5 wt % to 45 wt % glycerin, and 3 wt % to 43 wt % moisture.

In some embodiments, the smoking material portion may include a tobacco material, and the sound-generating material content relative to the tobacco material may be in a range of 2 wt % to 30 wt %.

In some embodiments, during a process of manufacturing the sound-generating material, glycerin may be added while a hardening agent is not added.

In some embodiments, the process of manufacturing the sound-generating material may include a molding operation in which a mixed solution including the carbohydrate material is fed to a molding apparatus to mold the mixed solution into a predetermined form and a drying operation in which an output of the molding operation is dried.

In some embodiments, the drying operation may be performed for five hours or more under conditions of a temperature in a range of 20° C. to 40° C. and a relative humidity in a range of 10% to 40%.

In some embodiments, a process of manufacturing the smoking material portion may include a rod forming operation in which a smoking material is put onto a wrapping material to form a rod, and the sound-generating material may be added along a machine direction (MD) during the rod forming operation.

In some embodiments, the sound-generating material may be a particulate material having an average diameter in a range of 0.2 mm to 4.0 mm.

In some embodiments, the sound-generating material may include a plurality of particulate materials, and the plurality of particulate materials may have a regular arrangement form in the smoking material portion.

Advantageous Effects

According to various embodiments of the present disclosure, by further providing an auditory effect during smoking through a sound-generating material, an improved smoking experience can be provided to a smoker.

Also, during manufacture of a smoking article, by adding a sound-generating material along with a tobacco material, an influence on the workability of manufacturing the smoking article can be minimized.

Also, during manufacture of the smoking article, by adding the sound-generating material along a machine direction (MD) using a separate supply device, the sound-generating material may have regular arrangement inside a smoking material portion. Accordingly, sound having a regular pattern (e.g., sound intensity, sound generation intervals) can be generated during smoking, and thus an improved smoking experience can be provided to the smoker.

Also, by manufacturing the sound-generating material on the basis of the carbohydrate material which is low-cost, the smoking article from which sound is generated can be manufactured at low cost.

Also, by manufacturing the sound-generating material on the basis of the carbohydrate material which is consumed by humans as food, safety of the smoking article can be guaranteed.

In addition, by utilizing the sound-generating material which is unrelated to a clove flavor, the smoking article from which sound is generated can also be provided to smokers who are not familiar with the clove flavor. That is, by manufacturing the sound-generating material on the basis of the carbohydrate material which is unrelated to a specific flavor, it is possible to provide a sound-generating material which can be universally applied to various smoking articles.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 illustrates an exemplary smoking article that may be referenced in various embodiments of the present disclosure.

FIGS. 2 and 3 illustrate a smoking article to which a sound-generating material in the form of particles is added according to a first embodiment of the present disclosure.

FIGS. 4 to 6 illustrate a smoking article to which a sound-generating material in the form of a sheet is added according to a second embodiment of the present disclosure.

FIGS. 7 to 9 illustrate a smoking material to which a sound-generating article in the form of elongated objects is added according to a third embodiment of the present disclosure.

FIG. 10 is an exemplary flowchart illustrating a method of manufacturing a smoking article according to some embodiments of the present disclosure.

FIG. 11 is an exemplary flowchart illustrating a method of manufacturing a sound-generating material according to some embodiments of the present disclosure.

FIG. 12 is an exemplary view for describing a method of adding a sound-generating material according to some embodiments of the present disclosure.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various different forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the possibility of the presence or addition of one or more components, steps, operations, and/or devices other than those mentioned.

First, some terms used in the following embodiments will be clarified.

In the following embodiments, the term "smoking article" may refer to any product that can be smoked or any product that can provide a smoking experience, regardless of whether the product is based on tobacco, tobacco derivatives, expanded tobacco, reconstituted tobacco, or tobacco substitutes. For example, smoking articles may include products that can be smoked, such as a cigarette, a cigar, and a cigarillo.

In the following embodiments, the term "smoking material" may refer to any material that is used in smoking. For example, the smoking material may include a tobacco material, and the tobacco material may include any kind of material based on tobacco raw materials such as ground tobacco leaves, expanded tobacco midribs, shredded tobacco (e.g., shredded tobacco leaves, shredded reconstituted tobacco leaves), and a tobacco sheet (e.g., reconstituted tobacco sheet).

In the following embodiments, the term "puff" refers to inhalation by a user, and the inhalation may refer to a user's act of drawing smoke into his or her oral cavity, nasal cavity, or lungs through the mouth or nose.

In the following embodiments, the term "upstream" or "upstream direction" may refer to a direction moving away from an oral region of a smoker, and the term "downstream"

or "downstream direction" may refer to a direction approaching the oral region of the smoker. The terms "upstream" and "downstream" may be used to describe relative positions of components constituting an aerosol-generating article. For example, in a smoking article 1 illustrated in FIG. 1, a smoking material portion 12 is disposed upstream or in an upstream direction of a filter portion 11, and the filter portion 11 is disposed downstream or in a downstream direction of the smoking material portion 12.

In the following embodiments, the term "longitudinal direction" may refer to a direction corresponding to a longitudinal axis of a smoking article.

Hereinafter, various embodiments of the present disclosure will be described in detail with reference to the accompanying drawings.

According to various embodiments of the present disclosure, a smoking article in which a sound-generating material is added to a smoking material portion so that sound is generated during smoking may be provided. Also, the sound-generating material may include a carbohydrate material (e.g., monosaccharide, polysaccharide). Since specific methods of adding the sound-generating material may vary, the smoking article may be designed and manufactured in various forms.

Prior to describing various forms of smoking articles, for convenience of understanding, an exemplary smoking article that may be referenced in various embodiments of the present disclosure will be described first.

FIG. 1 illustrates an exemplary smoking article 1 that may be referenced in various embodiments of the present disclosure.

As illustrated in FIG. 1, the smoking article 1 may include the filter portion 11 and the smoking material portion 12. However, only the components relating to the embodiment of the present disclosure are illustrated in FIG. 1. Therefore, those of ordinary skill in the art to which the present disclosure pertains should understand that the smoking article 1 may further include general-purpose components other than the components illustrated in FIG. 1. Also, those of ordinary skill in the art should easily understand that a detailed structure of the smoking article 1 may be modified to various forms. Hereinafter, the components of the smoking article 1 will be described.

The filter portion 11 may include a filter main body formed of a filter material and a filter wrapper wrapped around the filter main body. The filter portion 11 may be connected to one end of the smoking material portion 12. For example, the filter portion 11 and the smoking material portion 12 may have a rod shape and may be aligned in the longitudinal axis direction, and an upstream end of the filter portion 11 may be connected to a downstream end of the smoking material portion 12. The filter portion 11 and the smoking material portion 12 may be connected by a tipping wrapper, but the scope of the present disclosure is not limited thereto. In some embodiments, the filter portion 11 may also serve as a mouthpiece.

The filter main body may include cellulose acetate fibers (i.e., tow) as a filter material but is not limited thereto. In some embodiments, the filter main body may further include at least one filter material widely known in the art. For example, the filter main body may further include activated carbon, an adsorbent including carbon, and the like.

The filter portion 11 may be formed of a single filter or a multi-layer filter. Also, the filter portion 11 may include a cavity formed by the multi-layer filter, or a capsule containing a flavoring material may be disposed inside (e.g., in the cavity of) the filter portion 11. In this way, since a detailed structure of the filter portion 11 may be modified in various ways, the technical scope of the present disclosure is not limited by the detailed structure of the filter portion 11.

Next, the smoking material portion 12 may include a smoking material and a wrapper wrapped around the smoking material. The smoking material portion 12 may have a rod shape, but the technical scope of the present disclosure is not limited thereto.

The smoking material may include various kinds of materials that generate smoke and/or an aerosol or are used in smoking. The smoke and/or aerosol generated by the smoking material may be inhaled into the oral region of the smoker through the filter portion 11.

For example, the smoking material may include a tobacco material. For example, the tobacco material may include tobacco raw materials such as pieces of tobacco leaves and tobacco stems and materials obtained by processing the same. As a more specific example, the tobacco material may include ground tobacco leaves, expanded tobacco midribs, shredded tobacco (e.g., shredded tobacco leaves, shredded reconstituted tobacco leaves), a tobacco sheet (e.g., reconstituted tobacco sheet), and the like.

In some embodiments, the smoking material may further include an additive such as a wetting agent, a flavoring agent, and/or organic acid. For example, the wetting agent may include at least one of glycerin, propylene glycol, ethylene glycol, dipropylene glycol, diethylene glycol, triethylene glycol, tetraethylene glycol, and oleyl alcohol. The wetting agent may maintain moisture in the tobacco material at an optimum level and thus soften the inherent flavor and produce a large amount of vapor. Also, for example, the flavoring agent may include licorice, saccharose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, a clove extract (or a clove material), coffee, or the like.

In some embodiments, the smoking material may include a clove material. For example, the clove material may include clove powder, slices of the clove plant, or the like formed by grinding or processing the clove plant (e.g., clove leaves). In such a case, since a crackling (or "kretek-kretek") sound is generated during smoking, an auditory effect is added to the clove flavor, and thus an improved smoking experience may be provided to the smoker.

In some embodiments, in order to increase the clove flavor, a clove extract (e.g., clove oil) that includes the eugenol component may be added as a flavoring agent. Here, in order to improve a flavor retaining property of the flavoring agent, the flavoring agent may be added in the form of solidified porous granules. For example, the flavoring granules may be added to the filter portion 11, the smoking material portion 12, and/or a cavity formed in the filter portion 11 of the smoking article 1. According to the present embodiment, by making the clove extract into granules each having a porous structure, the volatility of the clove extract can be suppressed, and accordingly, the flavor retaining property of the flavoring agent can be significantly improved.

Hereinafter, a smoking article from which sound is generated will be described according to various embodiments of the present disclosure.

The sound generated from the smoking article may, by adding an auditory effect during smoking, provide an improved smoking experience to the smoker. For example, the sound generated from the smoking article may, by allowing the smoker to perceive the act of smoking as an amusing act, provide a unique smoking experience. Therefore, the inventors of the present disclosure have carried out continuous research on sound-generating materials that may be added to a smoking article. For example, the inventors have carried out continuous research on materials from which sound of a reference value or more is generated during burning. As a result of research, the inventors have surprisingly found that a carbohydrate material or a composition including the same has a characteristic of making sound while burning. More specifically, the inventors have confirmed that the carbohydrate material or composition thereof has such a characteristic because sound is generated as a crystal structure breaks or cracks are formed during burning.

When the carbohydrate material is utilized as a sound-generating material, the following various advantages may be secured. First, since the carbohydrate material is widely available and inexpensive, a smoking article from which sound is generated may be manufactured at low cost. For example, since the carbohydrate material is much cheaper than the clove material, the smoking article from which sound is generated may be manufactured at a lower cost than the kretek cigarette. Second, since the carbohydrate material is a material contained in potatoes, wheat, rice, corn, and the like and ordinarily consumed by people, the carbohydrate material is proven to be safe. Therefore, the cost required for proving the safety of the smoking article from which sound is generated may be significantly reduced.

As mentioned above, the sound-generating material may be the carbohydrate material or composition including the same. Here, the carbohydrate material may include a monosaccharide material and/or a polysaccharide material. For example, the polysaccharide material may include starch, agar, pectin, and the like, but is not limited thereto and may further include various other materials.

Also, in a case in which the sound-generating material is a composition, constituents of the sound-generating material and a composition ratio thereof may vary. For example, the sound-generating material may further include, in addition to including the carbohydrate material, at least one material of glycerin, moisture, propylene glycol (PG), a medium chain fatty acid triglyceride (MCTG), and a flavoring material.

As a more specific example, the sound-generating material may include about 15 wt % to 99 wt % carbohydrate material. Preferably, the sound-generating material may include the carbohydrate material in an amount greater than or equal to about 30 wt % or 40 wt %. This is because the sound intensity of the sound-generating material may increase with an increase in the carbohydrate material content in the sound-generating material (refer to Experimental Example 2 or the like).

As another example, the sound-generating material may include about 5 wt % to 70 wt % additive(s) (e.g., glycerin, moisture, PG, MCTG, and/or flavoring material). For example, the sound-generating material may include about 5 wt % to 50 wt % glycerin or, preferably, may include about 10 wt % to 40 wt % glycerin, about 15 wt % to 45 wt % glycerin, or about 15 wt % to 35 wt % glycerin. Glycerin may increase the hardness of the sound-generating material to maintain the form of the material and also increase the sound intensity. The experimental results (refer to Experimental Example 2 or the like) also showed that the sound intensity increases with an increase in the glycerin content of the sound-generating material. Also, glycerin and PG may also be added as moisturizing materials for the purpose of enhancing vapor production of the smoking article. The flavoring material may be added for the purpose of improving the flavor expressing property of the smoking article.

As still another example, the sound-generating material may include about 15 wt % to 90 wt % carbohydrate material, about 5 wt % to 45 wt % glycerin, and about 3 wt % to 43 wt % moisture. It was found that, within such composition ranges, the sound-generating material has an appropriate hardness and the sound intensity is also improved (refer to Experimental Examples 1, 2, and the like).

Meanwhile, methods of adding the sound-generating material to the smoking article may vary according to embodiments, and description relating thereto will be given in detail below with reference to FIG. 2 and so on. In the following description, for clarity of the specification, description of contents overlapping with those described above will be omitted. Refer to the above description relating to FIG. 1 for description of components of smoking articles 2 to 4 illustrated in the subsequent drawings.

First, a smoking article 2 according to a first embodiment of the present disclosure will be described with reference to FIGS. 2 and 3.

As illustrated in FIGS. 2 and 3, in the first embodiment, a sound-generating material 20 processed in the form of particles may be added to a smoking material portion 22 of the smoking article 2. Here, examples of the form of particles may include powder, granules, beads, and the like. Similar to the smoking article 1 illustrated in FIG. 1, the smoking article 2 consists of a filter portion 21 and the smoking material portion 22, and as mentioned above, a detailed structure of the smoking article 2 may be modified in various ways.

As illustrated in FIG. 2, the sound-generating material 20 in the form of particles (hereinafter referred to as "sound-generating particles 20") may be included in the smoking material portion 22. For example, the sound-generating particles 20 may be added along with a tobacco material (e.g., shredded tobacco) and disposed inside the smoking material portion 22 during the process of forming a smoking material rod. This method will be described in detail below with reference to FIG. 12. However, the scope of the present disclosure is not limited thereto, and the sound-generating particles 20 may also be added using another method.

Meanwhile, the shape, size, added amount, and/or arrangement of the sound-generating particles 20 may vary according to embodiments.

In some embodiments, the sound-generating particles 20 may have a shape similar to a sphere, and a diameter (e.g., average diameter) thereof may be in a range of about 0.2 mm to 4.0 mm. Preferably, the diameter may be in a range of about 0.5 mm to 4.0 mm or 0.5 mm to 3.0 mm. More preferably, the diameter may be in a range of about 0.8 mm to 2.0 mm. In this way, it may be preferable that the sound-generating particles 20 have an appropriate size. This is because, in a case in which the size is too small, the sound intensity may be reduced. On the other hand, if the size is too large, combustibility may be decreased and thus the sound intensity may be reduced (refer to Experimental Example 1 or the like).

In some embodiments, the mass fracture (added amount) of the sound-generating particles 20 may be in a range of about 1 wt % to 40 wt % or 2 wt % to 35 wt % relative to the tobacco material. Preferably, the content may be in a range of about 2 wt % to 30 wt % or 5 wt % to 35 wt % and, more preferably, may be in a range of about 10 wt % to 30 wt % or 15 wt % to 30 wt %. This is because, when the amount of the sound-generating particles 20 is too small, the sound generating effect may be insignificant. On the other hand, if the amount of the sound-generating particles 20 is too large, the sound may be too loud or the tobacco material content may be reduced, thus causing the taste of tobacco to be diminished. However, because the sound-generating particles 20 are relatively cheaper than the tobacco material, the material cost of the smoking article 2 may be reduced as the amount of the sound-generating particles 20 increases. The above-listed amount ranges of the sound-generating particles 20 may also similarly apply to a case in which the sound-generating particles 20 are added in a different form (e.g., the form of a sheet or an elongated object).

In some embodiments, the plurality of sound-generating particles 20 may have a regular arrangement form inside the smoking material portion 22 (see FIG. 2). For example, the plurality of sound-generating particles 20 may be disposed at predetermined intervals or uniformly distributed instead of being randomly disposed. In such a case, since sound may be constantly generated or the maximum deviation in sound intensity per puff may be less than or equal to a reference value (e.g., about 10 dB, 5 dB, etc.), a continuous and consistent auditory stimulation effect may be provided during smoking.

Also, according to some embodiments of the present disclosure, the sound generation patterns (e.g., loudness of sound, duration of sound, a sound generation interval, a sound change pattern, and the like) during smoking may be controlled by changing the size, added amount, distribution, arrangement intervals, arrangement form, and/or added positions of the sound-generating particles 20. For example, by adding the sound-generating particles 20 to be uniformly distributed inside the smoking material portion 22, it is possible to allow sound to be constantly generated during smoking. As another example, by adding a large amount of sound-generating particles 20 with a large size only to a specific segment of the smoking material portion 22, it is possible to allow a popping sound to be generated only at a specific point in time during smoking. As still another example, as illustrated in FIG. 3, by adding a smaller amount of the sound-generating particles 20 (e.g., the sound-generating particles 20 with a smaller size or a smaller number of the sound-generating particles 20) to a downstream-side segment 23-2 or 23-3 among the plurality of segments 23-1 to 23-3 constituting the smoking material portion 22 (e.g., by adding a smaller amount of particles toward the downstream side), it is possible to allow the sound to become gradually weaker as the smoking material is exhausted. Conversely, by adding a larger amount of the sound-generating particles 20 to the downstream-side segment 23-2 or 23-3 (e.g., by adding a larger amount of particles toward the downstream side), it is possible to allow the sound to become gradually louder as the smoking material is exhausted. In such a case, it is possible to achieve an effect of notifying the smoker of a smoking end time point through a sound change.

Meanwhile, according to some other embodiments of the present disclosure, the sound-generating particles 20 may be added to the wrapper wrapped around the smoking material. Here, the basis weight of the wrapper may be in a range of 30 $g/m^2$ to 60 $g/m^2$, preferably, 35 $g/m^2$ to 55 $g/m^2$, and more preferably, 40 $g/m^2$ to 50 $g/m^2$ or 42 $g/m^2$ to 48 $g/m^2$. In this way, it may be preferable that the wrapper has a basis weight greater than or equal to a reference value. This is because the wrapper has to be processed to a predetermined thickness or more in order to allow the sound-generating particles 20 having an appropriate size (that is, having an appropriate sound intensity) to be added to the wrapper.

The smoking article 2 according to the first embodiment of the present disclosure has been described above with reference to FIGS. 2 and 3. According to the above description, by adding the sound-generating material 20 processed in the form of particles to the smoking material portion 22, the smoking article 2 from which sound is generated may be easily manufactured, and an improved smoking experience may be provided to the smoker.

Hereinafter, a smoking article 3 according to a second embodiment of the present disclosure will be described with reference to FIGS. 4 to 6.

As illustrated in FIGS. 4 to 6, in the second embodiment, a sound-generating material 30 processed in the form of a sheet may be added to a smoking material portion 32 of the smoking article 3. Similar to the smoking article 1 illustrated in FIG. 1, the smoking article 3 consists of a filter portion 31 and the smoking material portion 32, and as mentioned above, a detailed structure of the smoking article 3 may be modified in various ways.

As indicated above, specific methods of adding the sound-generating material 30 processed in the form of a sheet (hereinafter referred to as "sound-generating sheet 30") to the smoking material portion 32 may vary.

In some embodiments, as illustrated in FIG. 4, the sound-generating sheet 30 may be added to be disposed adjacent to a tobacco sheet 33. For example, the sound-generating sheet 30 may be appropriately mixed with the tobacco sheet 33 (e.g., the sound-generating sheet 30 may be stacked on the tobacco sheet 33, attached to the tobacco sheet 33, or rolled together with the tobacco sheet 33) and added to the smoking material portion 32. For example, the tobacco sheet 33 may be a reconstituted tobacco sheet, but the scope of the present disclosure is not limited thereto. As another example, the sound-generating sheet 30 may be configured as a portion of the tobacco sheet 33. The sound-generating sheet 30 and the tobacco sheet 33 may be integrally formed and added to the smoking material portion 32.

In the embodiment described above, a thickness ratio of the sound-generating sheet 30 to the tobacco sheet 33 may be in a range of about 0.5:1 to 3:1. Preferably, the thickness ratio may be in a range of about 1:1 to 3:1, and more preferably, in a range of about 1:1 to 2:1 or 1.2:1 to 1.8:1. In this way, it may be preferable that the thickness of the sound-generating sheet 30 is larger than the thickness of the tobacco sheet 33. This is because, in general, the combustibility of the sound-generating sheet 30 is superior to that of the tobacco sheet 33. In this respect, it may be preferable that the sound-generating sheet 30 is processed to be slightly thicker than the sound-generating sheet 30 in order to make burning speeds of the two sheets 30 and 33 similar to each other.

In some other embodiments, as illustrated in FIG. 5, the sound-generating sheet 30 may be disposed on a wrapper 34 for wrapping a smoking material. For example, the sound-generating sheet 30 may constitute a portion of the wrapper 34 or may be attached to the inner surface of the wrapper 34. FIG. 5 illustrates an example in which the sound-generating sheet 30 is attached along the longitudinal direction of the smoking article 3, but the direction along which the sound-generating sheet 30 is attached may be changed. For example, as illustrated in FIG. 6, one or more sound-generating sheets 30-1 to 30-3 may be attached along the transverse direction of the smoking article 3.

Meanwhile, according to some embodiments of the present disclosure, the sound generation patterns during smoking may be controlled by changing the size (e.g., the length, thickness) of the sound-generating sheet 30, the position at which the sound-generating sheet 30 is disposed, an interval at which sound-generating sheets 30 are disposed, and/or an arrangement form of the sound-generating sheets 30. For example, as illustrated in FIG. 6, by arranging the sound-generating sheets 30-1 to 30-3 to be spaced apart at predetermined intervals, it is possible to allow sound to be generated at predetermined intervals during smoking. As another example, by arranging a smaller sound-generating sheet 30 in a downstream-side region of the wrapper 34 and arranging a larger sound-generating sheet 30 in an upstream-side region of the wrapper 34, it is possible to allow the sound to become gradually weaker as the smoking material is exhausted. Conversely, by arranging the larger sound-generating sheet 30 in the downstream-side region of the wrapper 34, it is possible to allow the sound to become gradually louder as the smoking material is exhausted. In such a case, it is possible to achieve the effect of notifying the smoker of a smoking end time point through a sound change.

The smoking article 3 according to the second embodiment of the present disclosure has been described above with reference to FIGS. 4 to 6. According to the above description, by adding the sound-generating material 30 processed in the form of a sheet to the smoking material portion 32, the smoking article 3 from which sound is generated during smoking may be easily manufactured, and an improved smoking experience may be provided to the smoker.

Hereinafter, a smoking article 4 according to a third embodiment of the present disclosure will be described with reference to FIGS. 7 to 9.

As illustrated in FIGS. 7 to 9, in the third embodiment, a sound-generating material 40 processed in the form of an elongated object may be added to a smoking material portion 42 of the smoking article 4. Here, the elongated shape includes any object shape that is slender and long. For example, the elongated shape may refer to a slender, long cylindrical shape such as the shape of a toothpick, but is not limited thereto. However, hereinafter, for convenience of understanding, the description will be continued assuming that the sound-generating material 40 is processed into an elongated cylindrical shape. Similar to the smoking article 1 illustrated in FIG. 1, the smoking article 4 consists of a filter portion 41 and the smoking material portion 42, and as mentioned above, a detailed structure of the smoking article 4 may be modified in various ways.

As indicated above, specific methods of applying the sound-generating material 40 processed in the form of an elongated object (hereinafter referred to as "sound-generating object 40") to the smoking article 4 may vary.

In some embodiments, as illustrated in FIG. 7, one or more sound-generating objects 40 may be disposed inside the smoking material portion 42. For example, the sound-generating object 40 may be disposed in the vicinity of the center of the smoking material portion 42. As another example, as illustrated in the cross-sectional view of FIG. 8, a plurality of sound-generating objects 40-1, 40-2, and the like may be disposed at designated positions in the smoking material portion 42.

In the embodiment described above, a diameter $d_2$ of the sound-generating object 40 may be in a range of about 1% to 40% of a diameter $d_1$ of the smoking material portion 42. Preferably, the diameter $d_2$ may be in a range of about 2% to 35% or 3% to 30% of the diameter $d_1$ of the smoking material portion 42 and, more preferably, may be in a range of about 5% to 20%, 6% to 18%, or 7% to 15% of the diameter $d_1$ of the smoking material portion 42. In this way, it is preferable that the diameter $d_2$ of the sound-generating object 40 is set to an appropriate length. The reasons are as follows.

First, when the diameter $d_2$ of the sound-generating object 40 is too small, the sound-generating object 40 may burn quickly, causing a duration of sound to become short. Also, the amount of the sound-generating material 40 may decrease, causing the intensity of sound to decrease. Also, since the sound-generating object 40 burns more quickly than the tobacco material, cigarette ash may be generated or scatter during smoking, causing inconvenience to the smoker and those around the smoker. Therefore, it may be preferable that the diameter $d_2$ of the sound-generating object 40 is greater than or equal to a predetermined value.

Conversely, when the diameter $d_2$ of the sound-generating object 40 is too large, the combustibility of the sound-generating object 40 may decrease, causing the intensity of sound to decrease. Also, the amount of tobacco material may decrease, causing the taste of tobacco to deteriorate. Therefore, it may be preferable that the diameter $d_2$ of the sound-generating object 40 is less than a predetermined value.

Also, an area of the sound-generating object 40 may be in a range of about 1% to 40% of an area of the smoking material portion 42. Preferably, the area of the sound-generating object 40 may be in a range of about 2% to 35% or 3% to 30% of the area of the smoking material portion 42 and, more preferably, may be in a range of about 5% to 20%, 6% to 18%, or 7% to 15% of the area of the smoking material portion 42. In this way, it is preferable that the area of the sound-generating object 40 is set to an appropriate size. The reasons are similar to those described above.

In some other embodiments, as illustrated in FIG. 9, the sound-generating object 40 cut into pieces may be added to the smoking material portion 42. Here, the sound-generating object 40 may be cut into the same size or different sizes.

Meanwhile, according to some embodiments of the present disclosure, the sound generation patterns during smoking may be controlled by changing the size (e.g., the length, thickness, volume) of the sound-generating object 40, the position at which the sound-generating object 40 is disposed, an interval at which sound-generating objects 40 are disposed, and/or an arrangement form of the sound-generating objects 40. For example, by arranging the sound-generating objects 40 to be spaced apart at predetermined intervals, it is possible to allow sound to be generated at predetermined intervals during smoking. As another example, as illustrated in FIG. 9, by arranging more sound-generating objects 40 in an upstream-side segment 42-1 among the plurality of segments 42-1 to 42-3 constituting the smoking material portion 42 and arranging less sound-generating objects 40 in the downstream-side segment 42-2 or 42-3, it is possible to allow the sound to become gradually weaker as the smoking material is exhausted. Conversely, by arranging more sound-generating objects 40 in the downstream-side segment 42-2 or 42-3, it is possible to allow the sound to become gradually louder as the smoking material is exhausted. In such a case, it is possible to achieve the effect of notifying the smoker of a smoking end time point through a sound change.

The smoking article 4 according to the third embodiment of the present disclosure has been described above with reference to FIGS. 7 to 9. According to the above description, by adding the sound-generating material 40 processed in the form of an elongated object to the smoking material portion 42, the smoking article 4 from which sound is generated may be easily manufactured, and an improved smoking experience may be provided to the smoker.

The smoking articles 2 to 4 according to the first to third embodiments of the present disclosure have been described above with reference to FIGS. 2 to 9. Although the embodiments have been separately described, the embodiments described above may also be combined in various forms. For example, two or more of the sound-generating particles 20, the sound-generating sheet 30, and the sound-generating object 40 may be added to the smoking material portion.

Also, the smoking articles 2 to 4 described above may generate sound during smoking, and the sound intensity may be in a range of about 20 dB to 80 dB, preferably in a range of about 40 dB to 70 dB or about 50 dB to 65 dB. Such sound intensities may, by providing a suitable level of auditory stimulation during smoking, further improve a smoking experience of the smoker. For reference, the sound intensity of the smoking articles 2 to 4 may be controlled by changing the size, added amount, constituents, and/or composition ratio of the sound-generating materials 20 to 40.

Also, in some embodiments, the maximum deviation in sound intensity per puff of the smoking articles 2 to 4 described above may be less than or equal to about 10 dB or 7 dB or, preferably, may be less than or equal to about 5 dB, 3 dB, or 1 dB. Here, the deviation per puff may be calculated on the basis of puffs in the middle of smoking (e.g., the third to seventh puffs), excluding puffs at the beginning and end of smoking (e.g., the first puff and the last puff). Since the deviation in sound intensity being less than or equal to a reference value indicates that constant sound is continuously generated, the smoking articles 2 to 4 having the deviation in sound intensity less than or equal to a reference value may provide an improved smoking experience to the smoker. For reference, the deviation in sound intensity may be controlled by changing the size, added amount, constituents, composition ratio, arrangement form, and/or arrangement interval of the sound-generating materials 20 to 40.

Further refer to Experimental Examples 1, 2, and the like regarding the sound intensity and deviation therein of the smoking articles 2 to 4.

Hereinafter, methods of manufacturing the sound-generating materials 20 to 40 and the smoking articles 2 to 4, which have been described above, will be described with reference to FIGS. 10 to 12.

FIG. 10 is an exemplary flowchart illustrating a method of manufacturing the smoking articles 2 to 4 according to some embodiments of the present disclosure.

As illustrated in FIG. 10, the manufacturing method may start with manufacturing a sound-generating material (S20). A detailed process of step S20 is illustrated in FIG. 11.

As illustrated in FIG. 11, the sound-generating material may be manufactured through preparing a mixed solution (S22), molding (S24), washing (S26), and drying (S28). However, in some other embodiments, some of the above steps may be omitted, or additional steps may be added. Hereinafter, each step will be described in detail.

In step S22, a mixed solution may be prepared. For example, components constituting the sound-generating material (e.g., a carbohydrate material, glycerin, PG, MCTG, a flavoring material, and the like) may be mixed with a solvent (e.g., water or the like) to prepare the mixed solution. The components constituting the mixed solution and a mixing ratio thereof may be changed, and accordingly, the constituents and/or a composition ratio thereof of the sound-generating material may also be changed. Also, a stirrer known in the art may be utilized to prepare the mixed solution, but the scope of the present disclosure is not limited thereto.

In step S24, the mixed solution may be molded into a predetermined form through a molding apparatus. For example, the mixed solution may be molded into the form of beads through an injection molding apparatus for producing beads (e.g., an injection molding apparatus using a 3-mm-diameter nozzle). However, the scope of the present disclosure is not limited thereto, and the molding apparatus may also mold the mixed solution into the form of a sheet, an elongated object, or the like.

For reference, in a case in which the mixed solution includes a carbohydrate material and a flavoring material (or flavoring liquid), the injection molding apparatus may produce beads in a form in which the carbohydrate material contains the flavoring material (e.g., the form of capsules).

Also, in step S24, a process of immersing an output of the molding apparatus (e.g., beads) into a MCTG solvent to cool the output may be further performed.

Meanwhile, as illustrated in FIG. 11, the process of manufacturing the sound-generating material may not include hardening, and this may be understood as a measure to further improve safety of the sound-generating material. That is, since a hardening agent is not added during manufacture of the sound-generating material, the safety of the sound-generating material may be further improved. For reference, a problem in which a hardness is decreased due to not adding a hardening agent may be alleviated by glycerin included in the mixed solution. This is because glycerin is a highly viscous material and may serve to increase the hardness of the sound-generating material. However, in some other embodiments, hardening may be further performed during manufacture of the sound-generating material.

In step S26, the output of the molding apparatus may be washed. For example, the output may be washed using a washing solvent such as ethanol. The washing may be performed one or more times.

In step S28, the washed output may be dried so that the sound-generating material is formed. The drying may be performed using various methods. For example, the drying may be performed using a rotary-type dryer. However, the scope of the present disclosure is not limited thereto.

Meanwhile, the moisture content in the sound-generating material may be controlled according to drying conditions, and various conditions may be set as the drying conditions.

In some embodiments, a temperature condition in a range of about 20° C. to 40° C., a relative humidity condition in a range of about 10% to 40%, and a drying time more than or equal to five hours may be set as the drying conditions. Here, the temperature condition, relative humidity condition, and/or drying time may be controlled within the above-mentioned numerical ranges. For example, a temperature condition of about 23° C., a relative humidity condition of about 18%, and a drying time more than or equal to ten hours may be set as the drying conditions.

Description will be continued by referring back to FIG. 10.

In step S40, the sound-generating material may be added to a smoking material rod. More specifically, while a wrapping material is filled with a tobacco material to form the smoking material rod, the sound-generating material may be added thereto. For convenience of understanding, step S40 will be additionally described with reference to FIG. 12. For reference, FIG. 12 conceptually illustrates the process of forming the smoking material rod in order to provide convenience of understanding, and the actual manufacturing method may be different. Also, FIG. 12 assumes that shredded tobacco 54 is used as the tobacco material.

As illustrated in FIG. 12, the shredded tobacco 54 may be supplied onto a wrapping material 51 by a shredded tobacco supply device 53, and simultaneously, a sound-generating material 50 may be added along a machine direction (MD) (that is, the longitudinal direction of the smoking article) by a separate supply device 52. In this way, smoking articles from which sound is generated (e.g., the smoking articles 2 to 4) may be manufactured at high speed without affecting the workability of the manufacturing process. Further, since the separate supply device 52 controls the supply of the sound-generating material 50, the arrangement form of the sound-generating material 50 may be easily controlled. For example, the supply device 52 may allow the sound-generating material 50 to be regularly arranged in rod-shaped shredded tobacco 55 or a smoking material rod 56. The supply device 52 may also control the amount of the sound-generating material 50.

As the shredded tobacco 54 and the sound-generating material 50 are wrapped with the wrapping material 51, the smoking material rod 56 may be formed, and the smoking material rod 56 may be later cut into a plurality of smoking material portions 56-1 and 56-2 (refer to step S60).

In step S60, as the formed smoking material rod is cut, the plurality of smoking material portions may be manufactured. The manufactured smoking material portions may correspond to the smoking material portions 22, 32, and 42 described above.

In step S80, the smoking material portion and a filter portion may be connected to form a smoking article. For example, the smoking material portion and the filter portion may be connected using a tipping wrapper to form the smoking article. The formed smoking article may correspond to the smoking articles 2 to 4 described above.

The methods of manufacturing the sound-generating material and the smoking article have been described above with reference to FIGS. 10 to 12.

Hereinafter, the configurations and effects of the smoking articles 2 to 4 described above will be described in more detail using examples and comparative examples. However, the following examples are only some examples of the smoking articles 2 to 4, and thus the scope of the present disclosure is not limited thereto.

Example 1

A smoking article having the same structure as the smoking article 2 illustrated in FIG. 2 was manufactured. During manufacture of the cigarette, about 600 mg of shredded tobacco and about forty pieces of sound-generating material manufactured in the form of beads were added, and the sound-generating material was added in such a way to have a regular arrangement form. Also, the sound-generating material was manufactured according to the method illustrated in FIG. 11. The manufactured sound-generating material consisted of about 33 wt % agar, about 19 wt % pectin, about 29 wt % glycerin, and about 19 wt % moisture and had a particle size in a range of about 1.0 mm to 1.25 mm.

Example 2

A cigarette identical to that of Example 1 was manufactured except that the particle size of the sound-generating material was in a range of about 0.5 mm to 0.75 mm.

Example 3

A cigarette identical to that of Example 1 was manufactured except that the particle size of the sound-generating material was in a range of about 1.5 mm to 1.75 mm.

Example 4

A cigarette identical to that of Example 1 was manufactured except that the particle size of the sound-generating material was in a range of about 2.0 mm to 2.25 mm.

Example 5

A cigarette identical to that of Example 1 was manufactured except that the particle size of the sound-generating material was in a range of about 2.5 mm to 2.75 mm.

Example 6

A cigarette identical to that of Example 1 was manufactured except that the sound-generating material consisted of about 27 wt % agar, about 21 wt % pectin, about 32 wt % glycerin, and about 20 wt % moisture.

Example 7

A cigarette identical to that of Example 1 was manufactured except that the sound-generating material consisted of about 39 wt % agar, about 21 wt % pectin, about 21 wt % glycerin, and about 19 wt % moisture.

Example 8

A cigarette identical to that of Example 1 was manufactured except that the sound-generating material consisted of about 55 wt % agar, about 31 wt % pectin, and about 14 wt % moisture.

Example 9

A cigarette identical to that of Example 1 was manufactured except that the sound-generating material consisted of about 15 wt % agar, about 16 wt % pectin, about 48 wt % glycerin, and about 21 wt % moisture.

Comparative Example 1

A cigarette identical to that of Example 1 was manufactured except that the same amount of clove plant slices was used as the sound-generating material.

Comparative Example 2

A cigarette identical to that of Example 1 was manufactured except that the sound-generating material was not added.

Table 1 below summarizes the conditions of the cigarettes according to Examples 1 to 9 and Comparative Examples 1 and 2.

TABLE 1

| Classification | Composition (wt %) | Particle size (mm) | Added amount |
|---|---|---|---|
| Example 1 | Agar: 33 | 1.0~1.25 | 40 ea/cig. |
| Example 2 | Pectin: 19 | 0.5~0.75 | |

TABLE 1-continued

| Classification | Composition (wt %) | Particle size (mm) | Added amount |
|---|---|---|---|
| Example 3 | Glycerin: 29 | 1.5~1.75 | |
| Example 4 | Moisture: 19 | 2.0~2.25 | |
| Example 5 | | 2.5~2.75 | |
| Example 6 | Agar: 27<br>Pectin: 21<br>Glycerin: 32<br>Moisture: 20 | 1.0~1.25 | |
| Example 7 | Agar: 39<br>Pectin: 21<br>Glycerin: 21<br>Moisture: 19 | 1.0~1.25 | |
| Example 8 | Agar: 55<br>Pectin: 31<br>Moisture: 14 | 1.0~1.25 | |
| Example 9 | Agar: 15<br>Pectin: 16<br>Glycerin: 48<br>Moisture: 21 | 1.0~1.25 | |
| Comparative Example 1 | Clove slices | — | Same as the amount of sound-generating material in Example 1 |
| Comparative Example 2 | — | — | — |

Experimental Example 1: Measurement of Sound Intensity According to Particle Size An experiment was conducted to measure the sound intensity of the smoking articles according to Examples 1 to 5 and Comparative Example 1. The experiment was conducted according to Health Canada (HC) smoking conditions using an automatic smoking device in a smoking room with a temperature of about 20° C. and humidity of about 62.5%. For the sound intensity, an average value of five measurement results was calculated, based on eight puffs per time. Also, BSWA 308 sound level meter was used to measure the sound intensity. The experimental results are shown in Table 2 below.

TABLE 2

| Classification | Sound intensity per puff (dB) | | | | | | | | | |
|---|---|---|---|---|---|---|---|---|---|---|
| (Average particle size) | 1 | 2 | 3 | 4 | 5 | 6 | 7 | 8 | Average | Standard deviation |
| Example 1 (1.15 mm) | 53.6 | 53.1 | 52.8 | 53.8 | 53.3 | 53.2 | 52.6 | 53 | 53.18 | 0.37 |
| Example 2 (0.625 mm) | 50.8 | 50.2 | 52 | 48.4 | 48.9 | 49.3 | 50.2 | 50.2 | 50.00 | 1.06 |
| Example 3 (1.625 mm) | 54.1 | 54.5 | 55.1 | 54.2 | 53.1 | 52.9 | 54.1 | 55.1 | 54.14 | 0.76 |
| Example 4 (2.125 mm) | 55.6 | 56.1 | 57.2 | 57.3 | 56.2 | 55.1 | 57.8 | 58.1 | 56.68 | 1.01 |
| Example 5 (2.625 mm) | 55.1 | 54.1 | 54.3 | 55.1 | 53.2 | 52.3 | 53.3 | 52.9 | 53.79 | 0.96 |
| Comparative Example 1 | 41 | 40.7 | 33.4 | 37.9 | 38.3 | 40.4 | 44 | 38.9 | 39.33 | 2.87 |

Referring to Table 2 above, it was found that the sound intensity of the smoking articles according to the examples significantly exceeded that of the smoking article according to Comparative Example 1. In this way, it can be seen that sound generation performance of the sound-generating material according to the examples is better than that of the clove material, and it can be seen that, when the sound-generating material is added, it is possible to manufacture a smoking article which provides a better smoking experience than kretek cigarettes.

Also, it was found that, with an increase in the average particle size, the sound intensity also generally increased. For example, the sound intensity of the smoking articles according to Examples 1 and 3 was found to be higher than that of the smoking material according to Example 2 in which the average particle size was smaller. However, in the case of Example 5 in which the average particle size was the largest, the sound intensity was found to be lower as compared to Example 4. This seems to be due to the correlation between particle size and combustibility. That is, since the combustibility of the sound-generating material decreases as the particle size increases, when the particle size is larger than or equal to a predetermined size, the sound generating effect may rather be degraded. This phenomenon seems to be the reason for the above.

Also, the deviation in sound intensity of the smoking articles according to the examples was found to be significantly less than that of the smoking article according to Comparative Example 1. This seems to be due to the sound-generating material added to the smoking articles according to the examples having a more regular arrangement than the clove material of Comparative Example 1. In this way, it can be seen that the smoking articles according to the examples may provide a significantly better smoking experience than kretek cigarettes.

Experimental Example 2: Measurement of Sound Intensity According to Material Composition An experiment was conducted to measure the sound intensity of the smoking articles according to Example 1 and Examples 6 to 9. The sound intensity measurement was performed in the same manner as in Experimental Example 1, and the experimental results are shown in Table 3 below. In Table 3 below, the experimental results relating to Comparative Example 1 are from Table 2 above.

TABLE 3

| Classification (carbohydrate content/glycerin content) | Sound intensity per puff (dB) | | | | | | | | | |
|---|---|---|---|---|---|---|---|---|---|---|
| | 1 | 2 | 3 | 4 | 5 | 6 | 7 | 8 | Average | Standard deviation |
| Example 1 (52%/29%) | 53.6 | 53.1 | 52.8 | 53.8 | 53.3 | 53.2 | 52.6 | 53 | 53.18 | 0.37 |
| Example 6 (48%/32%) | 53.6 | 51.2 | 51.8 | 50.2 | 52.2 | 53.2 | 52.6 | 53 | 52.23 | 1.06 |
| Example 7 (60%/21%) | 53.3 | 54.2 | 53.1 | 53.5 | 54.2 | 54.3 | 53.2 | 52.5 | 53.54 | 0.60 |
| Example 8 (86%/0%) | 48.4 | 49.8 | 48.4 | 50.8 | 51.4 | 48.8 | 50.6 | 49.06 | 49.66 | 1.09 |
| Example 9 (31%/48%) | 45.4 | 45.6 | 48 | 44 | 44.2 | 43.2 | 45.2 | 42.2 | 44.73 | 1.65 |
| Comparative Example 1 | 41 | 40.7 | 33.4 | 37.9 | 38.3 | 40.4 | 44 | 38.9 | 39.33 | 2.87 |

Referring to Table 3 above, the sound intensity of the smoking articles according to the examples was found to be significantly higher than that of the smoking article according to Comparative Example 1. In this respect, although sound intensity may differ according to composition ratios, it can be easily predicted that performance of the sound-generating material would be at least better than that of the clove material regardless of the composition ratio.

Also, referring to the experimental results relating to Example 1 and Examples 6 to 9 (except for Example 8), it was found that, with an increase in the carbohydrate material content, the sound intensity of the smoking articles also generally increased. In this respect, it can be seen that the carbohydrate material serves as a factor that causes sound to be generated.

Also, further referring to the experimental result relating to Example 8, it was found that, in a case in which glycerin is added at a certain amount, the sound intensity of the smoking article also increases. For example, it was found that, although the sound-generating material according to Example 8 included the largest amount of carbohydrate material, the sound intensity was lower as compared to the other examples. This seems to be due to glycerin serving to increase the hardness of the sound-generating material.

From the above experimental results, it can be seen that the carbohydrate material or the composition including the same is a better sound-generating material than the clove material, and the sound generation performance of the sound-generating material may be controlled by the carbohydrate material content. Also, it can be seen that it is preferable to add an appropriate amount of glycerin during manufacture of the sound-generating material.

Experimental Example 3: Evaluation of Workability of Manufacture

In order to evaluate an influence of addition of the sound-generating material on the workability of manufacturing the smoking article, the workability of manufacturing the smoking article according to Example 1 was compared with the workability of manufacturing the smoking article according to Comparative Example 2. As illustrated in FIG. 12, the sound-generating material was supplied by a separate supply device (e.g., the supply device 52), and there was no significant difference in terms of the manufacturing speed and defect rate of the smoking article. In this respect, it can be seen that, in a case in which the sound-generating material is added using the method illustrated in FIG. 12, the workability of manufacturing the smoking article is hardly affected.

Experimental Example 4: Property Analysis

In order to identify an influence of addition of the sound-generating material on properties of the smoking article, an experiment was conducted to measure properties of the smoking articles according to Example 1 and Comparative Example 2. The measurement items and measurement results are shown in Table 4 below. For reference, in Table 4 below, an air dilution rate may refer to a volume ratio of the volume of outside air entering the smoking article to the total volume of the final mainstream smoke.

TABLE 4

| Classification | Example 1 | Comparative Example 2 |
|---|---|---|
| Total weight (mg) | 918 | 887 |
| Dilution rate (%) | 67.5 | 69 |
| Draw resistance (mmH2O) | 163 | 162 |
| Circumference (mm) | 24.49 | 24.69 |
| Roundness (%) | 96.91 | 98.8 |

As shown in Table 4 above, it was found that the properties of the smoking article were hardly affected by the addition of the sound-generating material, except that the weight of the smoking article was slightly increased. In this respect, it can be seen that the sound-generating material according to the examples only have a positive effect of adding an auditory effect during smoking.

Experimental Example 5: Smoke Component Analysis

An experiment was conducted to analyze components of the smoke of the smoking articles according to Example 1 and Comparative Example 2. Specifically, smoke components were analyzed for the mainstream smoke of the smoking articles according to Example 1 and Comparative Example 2, and a smoking experiment was conducted according to Health Canada (HC) smoking conditions using an automatic smoking device in a smoking room with a temperature of about 20° C. and humidity of about 62.5%. The smoke was repeatedly collected three times for each sample, based on eight puffs per time. The average values of three collection results are shown in Table 5 below.

TABLE 5

| Classification | TPM (mg/cig.) | Tar (mg/cig.) | Nic. (mg/cig.) | CO (mg/cig.) | $CO_2$ (mg/cig.) | Moisture (mg/cig.) |
|---|---|---|---|---|---|---|
| Example 1 | 3.04 | 2.42 | 0.24 | 2.75 | 12.51 | 0.37 |
| Comparative Example 2 | 3.16 | 2.56 | 0.25 | 3.40 | 15.14 | 0.36 |

Referring to Table 5 above, migration amounts of nicotine and tar in Example 1 were found to be very similar to those in Comparative Example 2. This indicates that the overall smoking sensation (e.g., tobacco taste) felt by the smoker is almost the same for the smoking articles according to Example 1 and Comparative Example 2. In this respect, it can be seen that the smoking article according to the example only provides an auditory effect through the sound-generating material without affecting other aspects, and thus an improved smoking experience may be provided to the smoker.

The configurations of the smoking articles 2 to 4 described above and the effects thereof have been described in more detail above using various examples and comparative examples.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. A smoking article comprising:

a filter portion; and a smoking material portion to which a sound-generating material is added, wherein the sound-generating material includes:

15 wt % to 90 wt % a carbohydrate material;

5 wt % to 45 wt % glycerin; and 3 wt % to 43 wt % moisture.

2. The smoking article of claim 1, wherein an intensity of sound generated from the smoking article during smoking is in a range of 20 dB to 80 dB.

3. The smoking article of claim 1, wherein a standard deviation in sound intensity per puff generated from the smoking article during smoking is less than or equal to 5 dB.

4. The smoking article of claim 1, wherein the sound-generating material further includes at least one material of propylene glycol (PG), a medium chain fatty acid triglyceride (MCTG), and a flavoring material.

5. The smoking article of claim 1, wherein:

the smoking material portion includes a tobacco material; and the sound-generating material content relative to the tobacco material is in a range of 2 wt % to 30 wt %.

6. The smoking article of claim 1, wherein, during a manufacturing process of the sound-generating material, glycerin is added and a hardening agent is not added.

7. The smoking article of claim 1, wherein a manufacturing process of the sound-generating material includes a molding operation in which a mixed solution including the carbohydrate material is fed to a molding apparatus to mold the mixed solution into a predetermined form and a drying operation in which an output of the molding operation is dried.

8. The smoking article of claim 7, wherein the drying operation is performed for five hours or more under conditions of a temperature in a range of 20° C. to 40° C. and a relative humidity in a range of 10% to 40%.

9. The smoking article of claim 1, wherein:

a manufacturing process of the smoking material portion includes a rod forming operation in which a smoking material is put onto a wrapping material to form a rod; and the sound-generating material is added along a machine direction (MD) during the rod forming operation.

10. The smoking article of claim 1, wherein the sound-generating material is a particulate material having an average diameter in a range of 0.2 mm to 4.0 mm.

11. The smoking article of claim 1, wherein:

the sound-generating material includes a plurality of particulate materials; and the plurality of particulate materials have a regular arrangement form in the smoking material portion.

12. The smoking article of claim 1, wherein the sound-generating material is processed to a form of a sheet and added to the smoking material portion.

13. The smoking article of claim 12, wherein:

the smoking material portion includes a tobacco sheet; and the sound-generating material in the form of the sheet is disposed to be adjacent to the tobacco sheet in the smoking material portion.

14. The smoking article of claim 1, wherein the sound-generating material is processed to a form of an elongated object and added to the smoking material portion.

15. The smoking article of claim 1, wherein:

the smoking material portion includes a first segment disposed upstream and a second segment disposed downstream; and the sound-generating material is added in a larger amount to the first segment than to the second segment.

16. The smoking article of claim 1, wherein the carbohydrate material includes a monosaccharide material and/or agar.

* * * * *